US007614454B2

(12) United States Patent
Buyers et al.

(10) Patent No.: US 7,614,454 B2
(45) Date of Patent: Nov. 10, 2009

(54) DOWNHOLE ACTUATION METHOD AND APPARATUS FOR OPERATING REMOTE WELL CONTROL DEVICE

(75) Inventors: Mark Buyers, Dyce (GB); David Forsyth, Dyce (GB)

(73) Assignee: Omega Completion Technology, Limited, Aberdeen (GB)

( * ) Notice: Subject to any disclaimer, the term of this patent is extended or adjusted under 35 U.S.C. 154(b) by 297 days.

(21) Appl. No.: 11/487,590

(22) Filed: Jul. 14, 2006

(65) Prior Publication Data

US 2007/0012459 A1 Jan. 18, 2007

(30) Foreign Application Priority Data

Jul. 15, 2005 (GB) ..... 0514523.0

(51) Int. Cl.
*E21B 34/08* (2006.01)

(52) U.S. Cl. ..... 166/386; 166/319

(58) Field of Classification Search ..... 166/374, 166/381, 383, 386, 319, 324, 332.7
See application file for complete search history.

(56) References Cited

U.S. PATENT DOCUMENTS 5,101,907 A * 4/1992 Schultz et al. ..... 166/386
5,127,477 A 7/1992 Schultz
5,318,130 A * 6/1994 Manke ..... 166/373
2006/0076146 A1 4/2006 Veneruso et al.

FOREIGN PATENT DOCUMENTS

EP 0992652 A3 3/2004

* cited by examiner

*Primary Examiner*—Jennifer H Gay
*Assistant Examiner*—David Andrews
(74) *Attorney, Agent, or Firm*—Kirton & McConkie; Evan R. Witt

(57) ABSTRACT

A method for repeatably providing large operating forces to actuate a remote device in a well which includes well production means penetrating to some depth, surface means for restricting or closing-off flow of product from the well and changing well pressure during an operating sequence of the well, at least one downhole pressure storage chamber, a valve communicating between the pressure storage chamber and prevailing well pressure, a piston/cylinder device coupled with the remote device to actuate the latter, and isolation valve for controlling the supply of pressure energy from the storage chamber to the piston/cylinder device. The method includes the steps of replenishably storing pressure in the storage chamber during the operating sequence, such stored pressure being derived from fluid flow permitted by the valve, and repeatably operating the isolation valve to apply differential pressure to the piston/cylinder device to actuate the remote device.

14 Claims, 5 Drawing Sheets

DOWNHOLE ACTUATION METHOD AND APPARATUS FOR OPERATING REMOTE WELL CONTROL DEVICE

This invention relates to a downhole actuation method and apparatus for operating a remote well control device.

BACKGROUND OF THE INVENTION

In the oil and gas industries, petrochemicals and hydrocarbon gases are extracted from deep in the earth through pressure bearing tubulars or "tubing". The tubing forms a conduit from the rock where the petrochemicals reside to the surface where it is terminated at the Wellhead or Christmas Tree. The wellhead is equipped with a number of valves to control and contain the pressure which is present in the tubing.

The oil or gas flows from source rock which may exist in a layer of just a few feet to many hundreds of feet. The quality and productivity of the rock may vary over distance, and water or other undesirable elements may exist at certain points. Usually it is best practice to produce over the entire oil bearing interval and for any water to be produced along with the oil. Towards the latter stages of a well's life, the water production will generally increase at the expense of oil production. Production optimisation will depend on minimising the water production which will maximise the oil production.

Production may also be lost to "thief" zones. Thief zones are areas of rock penetrated by the wellbore which have less pressure than others. Crossflow can occur from a good high pressure zone to a poor low pressure zone. (See FIG. 1) Obviously, this is inefficient. Production optimisation will depend on isolating the thief zone until such time as the good high pressure zone has depleted to the extent that the pressure is the same or lower than the thief zone. Once the isolation has been removed, both zones may be allowed to flow to surface.

The production may initially be optimized by "shutting off" thief zones or water producing zones. Firstly, these zones must be identified and targeted. Instruments lowered into the wellbore on a wireline cable allow pressure, temperature, flow measurement and flow composition readings to be taken. Following analysis, a second intervention into the well may be conducted to mechanically close off the undesirable zone (s). A variety of equipment is available for this but most will dictate permanently closing off a part of the wellbore, which action may be undesirable in later years.

A technology whereby the zones of a well may be individually opened or closed to help optimise the production from that well is called "smart well" technology. Differing zones are mechanically separated and isolated by packer assemblies (See FIG. 2 demonstrating a well with three of these devices). Flow from the zones is received through a valve which may allow on/off or incremental flow. Most of these valves feature a sleeve which uncovers flow ports in the outside diameter of the tool. Many of these valves may be installed in a well with surface control being provided by means of electric cables, hydraulic control lines or other means. Most smart well systems require a physical link from the bottom of the well or the valve apparatus to surface in order to provide hydraulic contact, electrical contact or both. Not only is this expensive, it becomes a source of unreliability. Failure of one part of this type of system may compromise all of the system. Obviously, the complexity (and unreliability) of the installation increases proportionally with the number of valves and the increase in control lines and/or electric lines, splices and connections.

Equipment which uses this type of physical link must be installed when the well is new. It is not capable of retrofitting into an existing well.

The ability to repeatedly open and close various zones from surface allows true optimisation without the need to intervene in the well for data collection or for installation of shut off equipment. Also, isolated zones may easily and quickly be re-opened for evaluation and potential production later in the life of the well or simply just for re-evaluation purposes.

Many wells are not suited to intervention techniques due to the great cost associated with these operations. These may be sub sea wells where no facilities exist to support the intervention, high pressure wells where safety is a prime consideration or remote wells where also, no facilities exist.

Recent innovations in the electro magnetic and acoustic fields have sought to mitigate the disadvantages of the physical link to surface and associated unreliability. Other similar developments include pressure measurement at the proximity of the valve device to detect flow modulation signals. All these devices may offer a greater degree of flexibility and possibly higher reliability. They utilise batteries for powering the signal detection element of their design and accordingly, management of power consumption is of critical importance to guarantee a long service life. Once the actuation signal has been detected, the flow control valve must be operated. This may be performed by using an hydraulic pump providing pressure to a piston arrangement or by using an electric motor acting on a leadscrew. As large forces are required, both these methods consume large amounts of power requiring a substantial battery pack to provide a modest amount of openings and closings of the valve sleeve.

A large number of downhole tools exist which utilise well pressure for their operation. Some contain a Nitrogen chamber which allows internal hydraulics to be referenced to well pressure or to provide a reservoir of trapped energy. An alternative method is to reference an hydraulic piston to an air chamber. This pressure differential between well hydrostatic pressure and atmospheric pressure may provide large shifting forces. The pressure imbalance may be used to generate large forces for opening or closing valves, packing off rubber sealing elements or performing significant mechanical functions.

Multi shot devices do exist performing similar functions but are less common. These tools convey their finite energy from surface by using batteries, explosives or large volume air chambers dictating a limited number of cycles before retrieval for refreshment is required. In the case of air chambers, the number of cycles is dictated by the finite volume of the air chamber. Other devices requiring multiple cycles may have a mechanical link to surface which is utilised to provide electrical or hydraulic energy to the downhole location.

The valve or device which must be operated downhole requires a certain amount of energy to physically change its position. Formation of scale, wax, corrosion or friction may require quite large forces to perform this action.

It may be possible that a pressure differential exists between the production tubing and the casing which might be utilised. This type of differential may be sufficient to provide the large forces required but in order to access this pressure source, modification of the tubing to communicate with the annulus will be required. This is a complex operation and may be undesirable in terms of the safety implications for operation of the well.

Accordingly, the present invention seeks to provide an alternative means of providing multiple cycles of large operating forces available without the need of retrieval to surface for replenishment of the energy source and without the need for communicating with surface by way of an hydraulic conduit or electrical link.

BRIEF SUMMARY OF THE INVENTION

The invention seeks to utilise the normally occurring pressure modulations which all wells possess, whether they are high pressure wells, injection wells, normally flowing wells, pumped wells or wells which are produced with other secondary recovery techniques such as gas lift. All wells exhibit pressure excursions when the pressure will be greater or less than the norm for a period of time. This will occur as a result of the well changing state from flowing to shut in as a result of operational requirements. The invention utilises the pressure differentials or modulations which normally occur in a well during scheduled operational events.

Preferably, the required differential pressure should be sourced and contained within the tubing. During the operation of a well, the normal mode for the well is the flowing condition where oil or gas is extracted from the well. The pressure in a well drops when it is flowing, both downhole and at surface. Occasionally for operational or maintenance purposes, the well is shut in. The pressure in a well increases substantially when it is shut in. The difference between flowing and shut in pressure may be hundreds or even thousands of pounds per square inch. Choking back or reducing the production of a well will also have the effect of increasing the pressure but not to the same extent as shutting in the well.

The essence of the invention is the entrapment of an appropriate volume of pressure at its highest or lowest level in order to reference an operating piston with that pressure and secondly, referencing the other side of that operating piston with the opposite level of pressure available in the well whether that be high or low pressure. The need to operate downhole valves is only occasional with pressure fluctuations of the magnitude required for operation being present more frequently than any perceived equipment operation, thus allowing and providing multiple operations. In any event, should operation of the equipment be desired without a necessary pressure variation being experienced, the well may be shut in to provide the necessary high pressure reference point.

According to aspects of the invention there are provided methods and apparatus as defined in any one of claims 1, 8, 9 or 10. Preferred aspects are set out in dependent claims 2 to 7.

One preferred method of operation according to the invention will now be described with reference to FIG. 3, by way of example only.

DESCRIPTION OF PREFERRED EMBODIMENTS

Two pressure reservoir chambers are hydraulically linked to an operating piston. The operating piston is linked to a remote device disposed in a well e.g. a flow control valve or other device which can regulate or shut off flow from the well or a particular zone or another piece of equipment. One chamber is a low pressure chamber, the other is a high pressure chamber. Each chamber is equipped with a non return valve communicating with the well pressure. The non return valves are oriented differently such that one will allow pressure into the chamber but not out and the other will allow pressure out of the chamber but not in. Accordingly, one chamber (the high pressure one) will trap high pressure of the maximum value experienced in the well during the operating period. The other chamber will reference the lowest pressure experienced in the well during that period. The chambers are isolated from the operating piston by normally closed isolation valves which may be operated in response to a signal recognised by the telemetery section of the tool as previously mentioned or by other means. The isolation valves are arranged in two sets (A and B) such that pressure differential is directed to both sides of the operating piston allowing operation in either direction. The operating piston may be shifted to either an open or closed position depending on whether the high pressure is directed to the top of the operating piston and the low pressure to the bottom or visa versa or by opening valves "A" or valves "B".

Figure 1:
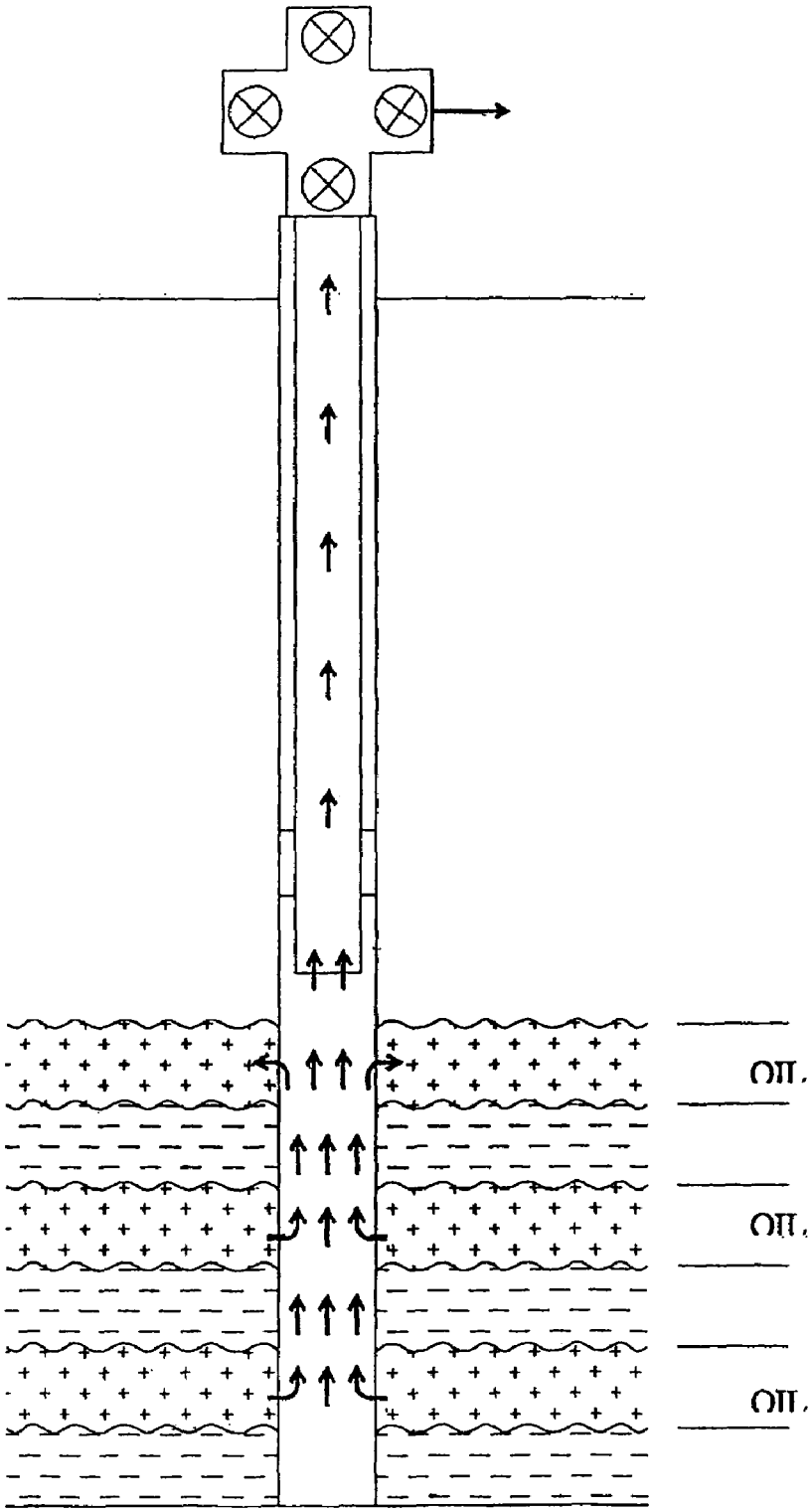
FIG. 1 is a cross-sectional representation of an oil or gas wellbore showing crossflow from high pressure zones to low pressure zones in the source rock.
Figure 2:
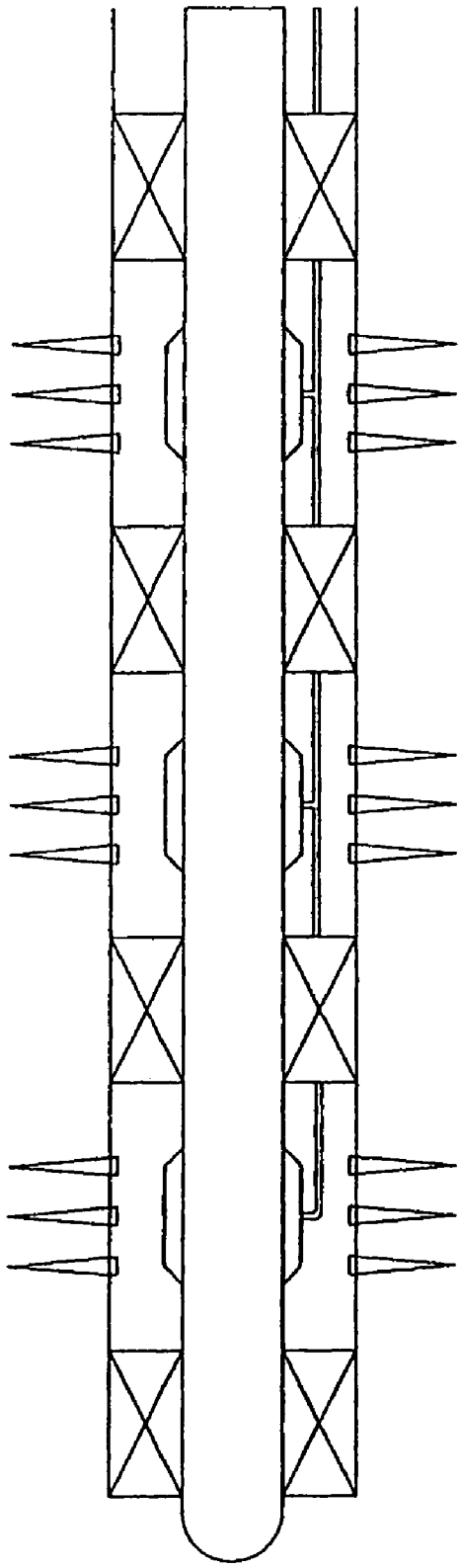
FIG. 2 is a cross-sectional representation of an oil or gas well containing packer assemblies.
Figure 3:
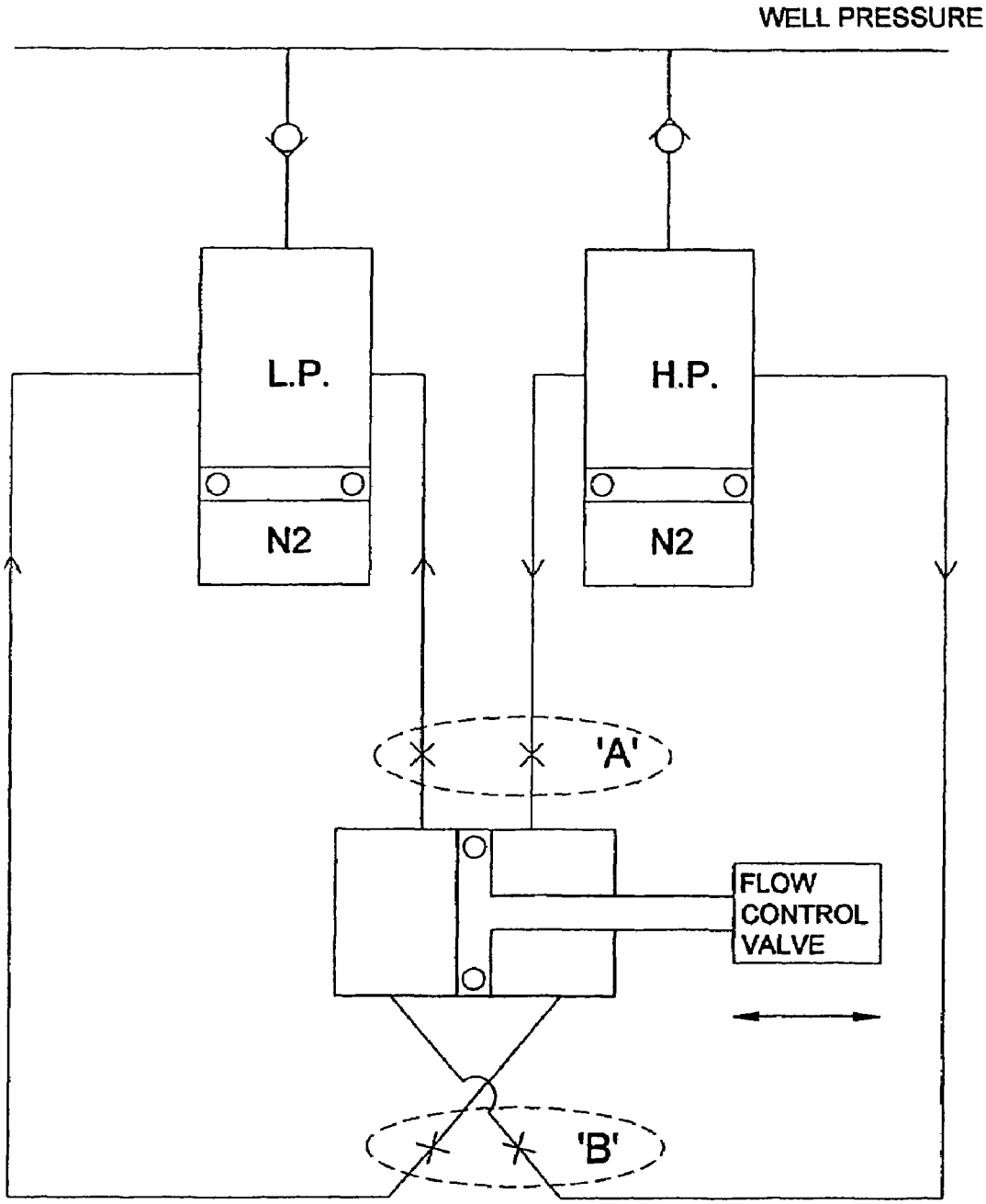
FIG. 3 is a schematic representation of an embodiment of the invention having two chambers.
Figure 4:
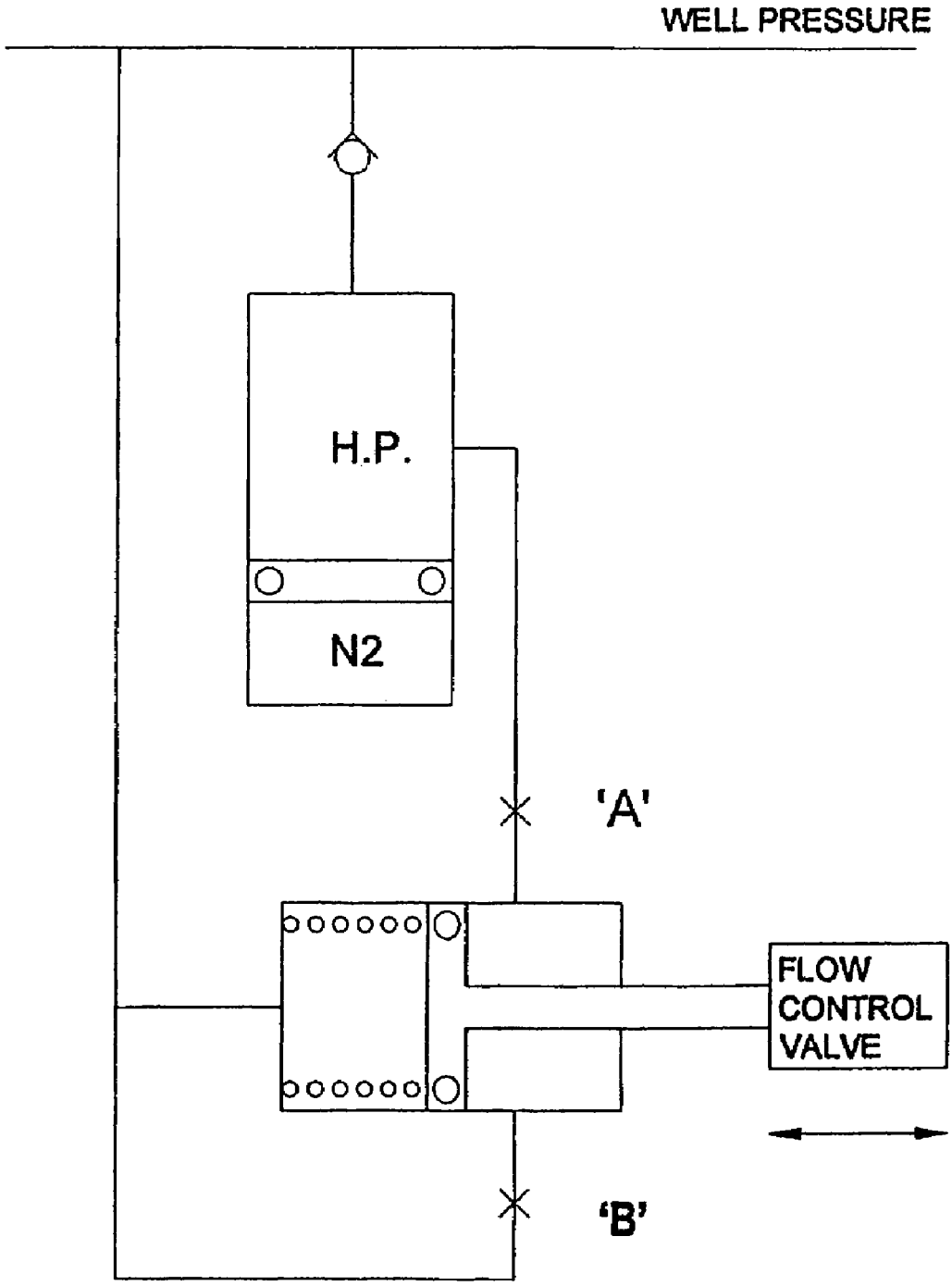
FIG. 4 is a schematic representation of another embodiment of the invention having one chamber.

Another example of a method according to the invention utilises a device as shown in FIG. 4. This device operates using the same principals but has only one chamber. If we imagine a well which has a flowing bottom hole pressure of five thousand psi. When the well is shut in, the bottom hole pressure increases to six thousand psi. The device is equipped with a single sealed chamber which features an inlet equipped with a non return valve whereby pressure may enter the chamber but not leave. When the well returns to the normal flowing condition from being shut in, an extra 1,000 psi is trapped in this chamber. A valve (A) situated on the outlet from this chamber when opened will allow this high pressure to transmit to the operating piston which has the well flowing pressure referencing the other side. A differential pressure of one thousand psi has now been applied to the piston creating a force which will move the piston, allowing operation of the flow control valve or other device. A spring situated in the well pressure reference chamber will return the piston to its starting point when the high pressure has been bled off to the well pressure by closing valve (A) and opening of the second valve (B), allowing the pressure to equalise.

Figure 5:
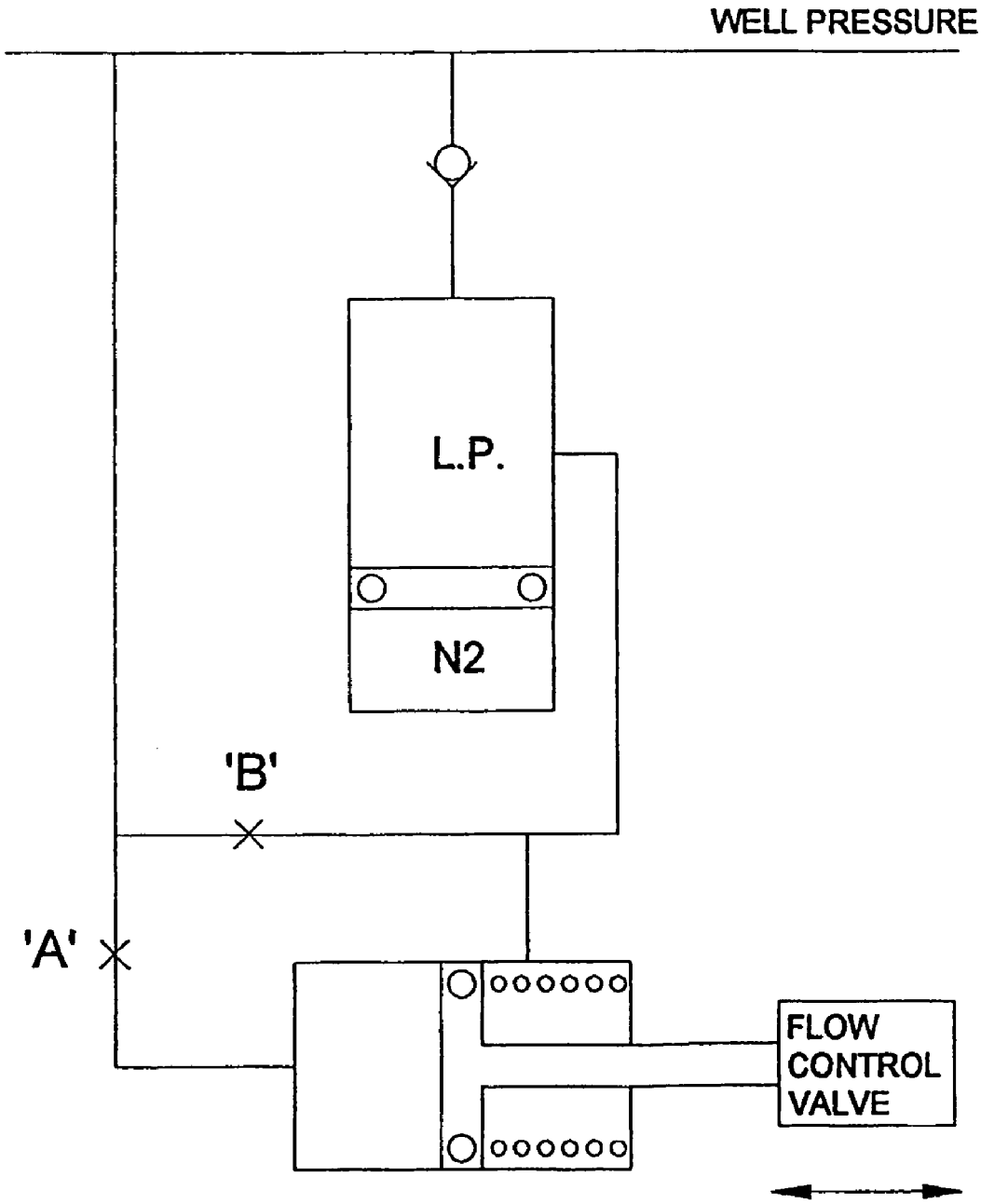
FIG. 5 is a schematic representation of yet another embodiment of the invention having one chamber.

Another example is similar but opposite to the above (FIG. 5). The same well is flowing at five thousand psi and increases to six thousand psi when shut in. The same chamber is equipped with a non return valve but one which prevents pressure flow into the chamber. The pressure in the chamber will now vent to the well pressure and will reference and trap the minimum pressure present in the well adjacent to the device. This may be described as a "low pressure chamber". If the well is shut in or choked back and the pressure builds up one thousand psi, the necessary differential now exists between the low pressure chamber and the well pressure. Opening of a valve (A) to allow the pressure to transmit will result in a differential pressure of one thousand psi which will be applied to the piston, creating a force which will move the piston allowing operation of the valve or other device. Opening of A and B will equalise both sides of the piston and allow a spring to return the piston back to its original position. The Low Pressure chamber will also equalise with well pressure but this pressure will be dumped at the next pressure cycle or modulation in preparation for the subsequent operation.

The large forces necessary to operate the flow control valve need not rely on the well being shut in to provide a high pressure differential. If only a few hundred psi are available, the operating piston may have its surface area increased in order that the available pressure differential is multiplied sufficiently to provide the desired opening force. Should packaging constraints prevent sufficient surface area from being provided, a multi piston arrangement may be considered.

The position of the flow control valve may be altered back to its original state in the two ways previously mentioned. A spring or other biasing means may return the piston back to its original position when the high pressure is removed or reversal of pressure differential across the piston will pump the operating piston back.

The flow control valve need not necessarily be of the on/off type. The technique described can equally well be utilised as a means of changing the position of a valve means to incrementally control well flow when used in conjunction with a positional metering device or other means of limiting the stroke (and position) of a valve sleeve.

The technique as described may also be utilised for other devices located in a wellbore. A safety valve may be used to shut in a well either in response to a calamatous event or as a preventative safety measure. A safety valve which has no communication to surface, such as a retrofittable safety valve, would benefit from the method as described. The safety valve may be signalled by electro magnetic, acoustic or pressure modulation techniques. Upon receipt of an actuation signal, the trapped pressure (high, low or both) may be communicated with the operating piston which will function the safety valve and close off flow from the well.

The volume of the chambers must be sufficient to provide a reservoir of sufficient capacity to accommodate the full stroke of the operating piston. As volume is withdrawn from the chamber, the pressure will drop. In the case of a monophasic fluid, this pressure drop will be drastic. For gas however, the pressure drop will be minimal. A desirable enhancement for the pressure chambers is fitment of an accumulator type assembly. This may be mechanical in the form of a spring or preferably, a nitrogen chamber which is precharged before installation in the well. Nitrogen is an inert gas with a large molecular size which makes it suitable for this purpose as the prospect of gas leaking from the device is reduced.

The single chamber approach, particularly the low pressure chamber as demonstrated in FIGS. 4 and 5 has several advantages, The main advantage is the ability to provide assistance from surface in the event that partial closure is suspected. In this circumstance, extra pressure applied to the well at surface will provide a greater differential than that already experienced and accordingly, a greater closing force. Also, if the low pressure version is chosen, the Nitrogen accumulator and low pressure chamber will be at the same pressure as the flowing well for much of its lifetime. This will reduce stress on all components and lead to a more reliable installation. The downside of this is that the well must be deliberately choked in order to provide the necessary pressure differential. This action may in itself be one of the operating modes for the telemetry of the device and in any case is considered an easy trade off for the reliability of the system.

We claim:

1. A method for repeatably providing large operating forces to actuate a remote device in a well, and said well comprising:

well production means penetrating to some depth;

surface means for restricting or closing-off flow of product from the well and changing well pressure in so doing during an operating sequence of the well;

downhole pressure storage chambers comprising a low pressure storage chamber and a high pressure storage chamber;

valve means for communicating between the pressure storage chambers and prevailing well pressure;

a piston/cylinder device coupled with the remote device to actuate the latter; and isolation valve means for controlling the supply of pressure energy from the storage chambers to the piston/cylinder device;

in which the method comprises the following steps:

(a) replenishably storing pressure in the storage chambers which are at respectively low and high extremes of well pressure during the operating sequence, such stored pressures being derived from fluid flow permitted by said valve means; and (b) repeatably operating the isolation valve means when required in order to apply differential pressure to the piston/cylinder device to actuate the remote device.

2. A method according to claim 1, in which the high pressure storage chamber communicates with well pressure via a one-way valve permitting fluid flow only in the direction to the chamber, and the low pressure storage chamber communicates with well pressure via a one-way valve permitting fluid flow only in a direction from the chamber.

3. A method according to claim 2, in which the low pressure chamber communicates with one side of the piston of the piston/cylinder device via a respective isolation valve, and the high pressure chamber communicates with an opposite side of the piston via a respective isolation valve, thereby to apply differential pressure to actuate the piston/cylinder device.

4. A method according to claim 1, in which the high pressure storage chamber communicates with well pressure via a one-way valve permitting fluid flow only to the chamber, thereby to charge the chamber with maximum well pressure generated during the operating sequence.

5. A method according to claim 4, in which well pressure is applied to one side of the piston of the piston/cylinder device, and higher pressure is applied to the opposite side of the piston from the high pressure storage chamber upon operation of the isolation valve means, thereby to apply differential pressure to actuate the piston/cylinder device.

6. A method according to claim 1, in which the low pressure storage chamber communicates with well pressure via a one-way valve permitting fluid flow only in a direction out of the chamber, in order that the chamber stores pressure at minimum well pressure generated during the operating sequence.

7. A method according to claim 6, in which well pressure is applied to one side of the piston of the piston/cylinder device, and lower pressure is applied to the opposite side of the piston from the low pressure chamber upon operation of the isolation valve means, thereby to apply differential pressure to actuate the piston/cylinder device.

8. A method for repeatably providing large operating forces to actuate a remote device disposed in a well comprising:

well production means penetrating to some depth;

surface means for restricting or closing-off flow of product from the well and modulating well pressure in so doing;

sealed downhole pressure storage chambers comprising a low pressure storage chamber and a high pressure storage chamber;

non-return valve means communicating between the pressure storage chambers and well pressure;

a piston/cylinder device referencing pressure from the pressure storage chambers to provide an actuating force to operate said remote device; and two or more isolation valve means between the pressure storage chambers and the piston/cylinder device, and between well pressure and the piston/cylinder device:

in which well pressure is trapped at the highest and lowest extremes to provide a reservoir of pressure differential deployed upon operation of isolation valve means, allowing differential pressure to act upon the piston of the piston/cylinder device, and thereby to actuate said remote device.

9. A method for repeatably providing large operating forces to a remote device disposed in a well, said well comprising:

well production means penetrating to some depth;

surface means for restricting or closing-off flow of product from the well and modulating well pressure in so doing;

two sealed downhole pressure storage chambers, one containing high pressure fluid, and the other containing low pressure fluid;

non-return valve means communicating between the pressure storage chambers and with well pressure; and a piston/cylinder device referencing pressure from the pressure storage chambers to provide opening/closing force for actuating said remote device:

in which well pressure is trapped at the highest and lowest extreme to provide a reservoir of pressure differential deployed upon operation of isolation valve means, allowing differential pressure to act upon the piston of the piston/cylinder device and thereby to actuate said remote device.

10. A method for repeatably providing large operating forces to actuate a remote device in a well, and said well comprising:

well production means penetrating to some depth;

surface means for restricting or closing-off flow of product from the well and changing well pressure in so doing during an operating sequence of the well;

a high pressure downhole storage chamber;

a low pressure downhole storage chamber;

valve means for communicating between the pressure storage chamber and prevailing well pressure;

a piston/cylinder device coupled with the remote device to actuate the latter; and isolation valve means for controlling the supply of pressure energy from the storage chamber to the piston/cylinder device;

in which the method comprises the following steps:

(a) replenishably storing pressure in the high pressure storage chamber which is at one extreme of well pressure during the operating sequence, such stored pressure being derived from fluid flow permitted by said valve means, the high pressure storage chamber communicating with well pressure via a one-way valve of said valve means, which valve permits fluid flow only in the direction to the chamber;

(b) replenishably storing pressure in the low pressure storage chamber which is at another extreme of well pressure during the operating sequence, such stored pressure being derived from fluid flow permitted by said valve means, the low pressure storage chamber communicating with well pressure via a one-way valve of said valve means, which valve permits fluid flow only in a direction from the chamber; and (c) repeatably operating the isolation valve means when required in order to apply differential pressure to the piston/cylinder device to actuate the remote device.

11. A method for repeatably providing large operating forces to actuate a remote device in a well, and said well comprising:

well production means penetrating to some depth;

surface means for restricting or closing-off flow of product from the well and changing well pressure in so doing during an operating sequence of the well;

at least one downhole pressure storage chamber;

valve means for communicating between the pressure storage chamber and prevailing well pressure;

a piston/cylinder device coupled with the remote device to actuate the latter; and isolation valve means for controlling the supply of pressure energy from the storage chamber to the piston/cylinder device;

in which the method comprises the following steps:

(a) replenishably storing pressure in the storage chamber which is at one extreme of well pressure during the operating sequence, such stored pressure being derived from fluid flow permitted by said valve means, the storage chamber communicating with well pressure via a one-way valve of the valve means which permits fluid flow only in a direction out of the chamber, in order that the chamber stores pressure at minimum well pressure generated during the operating sequence; and (b) repeatably operating the isolation valve means when required in order to apply differential pressure to the piston/cylinder device to actuate the remote device.

12. A method for repeatably providing large operating forces to actuate a remote device in a well, and said well comprising:

well production means penetrating to some depth;

surface means for restricting or closing-off flow of product from the well and changing well pressure in so doing during an operating sequence of the well;

at least one downhole pressure storage chamber comprising a low pressure storage chamber;

valve means for communicating between the pressure storage chamber and prevailing well pressure;

a piston/cylinder device coupled with the remote device to actuate the latter; and isolation valve means for controlling the supply of pressure energy from the storage chamber to the piston/cylinder device;

in which the method comprises the following steps:

(a) replenishably storing pressure in the low pressure storage chamber which is at a low extreme of well pressure during the operating sequence, such stored pressure being derived from fluid flow permitted by said valve means; and (b) repeatably operating the isolation valve means when required in order to apply differential pressure to the piston/cylinder device to actuate the remote device.

13. A downhole actuation apparatus for repeatably providing large operating forces to actuate a remote device in a well, said well comprising: well production means penetrating to some depth; and surface means for restricting or closing-off flow of product from the well and changing well pressure in so doing during an operating sequence of the well;

wherein the downhole actuation apparatus comprises:

downhole pressure storage chambers comprising a low pressure storage chamber and a high pressure storage chamber;

valve means for communicating between the pressure storage chambers and prevailing well pressure;

a piston/cylinder device coupled with the remote device to actuate the latter; and isolation valve means for controlling the supply of pressure energy from the storage chambers to the piston/cylinder device;

and wherein the apparatus is configured such that:

(a) pressure at respectively low and high extremes of well pressure is replenishably stored in the respective storage chambers during the operating sequence, such stored pressures being derived from fluid flow permitted by said valve means; and (b) the isolation valve means is repeatedly operated when required in order to apply differential pressure to the piston/cylinder device to actuate the remote device.

14. A downhole actuation apparatus for repeatably providing large operating forces to actuate a remote device in a well, said well comprising: well production means penetrating to some depth; and surface means for restricting or closing-off flow of product from the well and changing well pressure in so doing during an operating sequence of the well;

wherein the downhole actuation apparatus comprises:

at least one downhole pressure storage chamber comprising a low pressure storage chamber;

valve means for communicating between the pressure storage chamber and prevailing well pressure;

a piston/cylinder device coupled with the remote device to actuate the latter; and isolation valve means for controlling the supply of pressure energy from the storage chamber to the piston/cylinder device;

and wherein the apparatus is configured such that:

(a) pressure at a low extreme of well pressure is replenishably stored in the low pressure storage chamber during the operating sequence, such stored pressure being derived from fluid flow permitted by said valve means; and (b) the isolation valve means is repeatably operated when required in order to apply differential pressure to the piston/cylinder device to actuate the remote device.

* * * * *